United States Patent [19]

Miceli

[11] Patent Number: 4,726,273

[45] Date of Patent: Feb. 23, 1988

[54] COMBINATION PRESS FOR DIE-SETS

[76] Inventor: John P. Miceli, 1900 Shanklin Ave., Baltimore, Md. 21234

[21] Appl. No.: 932,798

[22] Filed: Nov. 20, 1986

[51] Int. Cl.[4] ..... B21D 28/02; B26F 1/02

[52] U.S. Cl. ..... 83/629; 72/449; 83/637; 83/639

[58] Field of Search ..... 83/629, 639, 637, 530; 72/449

[56] References Cited

U.S. PATENT DOCUMENTS

| | | | |
|---|---|---|---|
| 1,817,428 | 8/1931 | Takamatsu | 83/629 |
| 3,043,586 | 7/1962 | Boule | 83/629 X |
| 3,881,343 | 5/1975 | Ducate | 72/455 |
| 4,468,995 | 9/1984 | Mireles-Saldivar | 83/629 X |

*Primary Examiner*—Frank T. Yost

*Attorney, Agent, or Firm*—John F. McClellan, Sr.

[57] ABSTRACT

A bench press for small die sets has a rack and pinion that can serve several purposes; as a manual-power drive, as an adjustable stop, when the bench press has a power drive, and as an index that adjustably fixes orientation of the top plate relative to the base. Choice of orientation permits work to be advanced to a die set carried by the bench press from any of four directions and similarly permits access to the handle of the pinion from left or right, front or back. The pinion and handle travel up and down with the upper plate of the bench press and the rack is stationary.

10 Claims, 3 Drawing Figures

A
10
38
64
68
70
72
66
62
74
76
78
80
58
90
82
88
36
86
60
84
2
34
P
32
26
28
30
2
22
92
D
50
40
54
42
20
48
46
44

COMBINATION PRESS FOR DIE-SETS

FIELD OF THE INVENTION

This invention relates generally to machine tools and particularly to small, self-contained bench tools for precision die set use.

BACKGROUND OF THE INVENTION in the prior art precision guides for die-set use are known, one being described particularly in reference to clamping, in U.S. Pat. No. 3,881,343 issued to John S. Ducate on 5-6-75, and having a pair of guide pins in the lower plate guiding the upper plate, but being relatively complex and lacking the versatile orientability, choice in drive, and stop adjustments of the present invention.

Commercially available components for mounting and precision guiding of die sets are known, but taken alone fail to provide the versatile adjustability ahd convenience of the present invention, which is a preferred embodiment can employ such commercially available components.

Numerous patents directed to arbor presses disclose use of rack and pinion drives, but they generally are not intended to serve as precise alignment devices for die sets.

Racks are not known that serve as indexing elements providing different accesses, as, for example, right or left hand, front or back, to punchholders, and even more, that provide for the pinion to travel in coaction with such racks.

SUMMARY OF THE INVENTION

Objects of the present invention are to provide a combination press system for die sets that is compact and simple and can use commercially obtainable precision elements to a substantial extent, but that provides flexibility in choice of working access, left-handed, right-handed, back or front, for example, and that employs a rack and pinion subsystem as an indexing means, an adjustable stop means, and a powering means, as needed.

Further objects are to provide a system as described that is economical, durable, easy to use and adaptable to a variety of uses.

The system can be driven either by rack and pinion or by air or by hydraulic drive, as desired.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
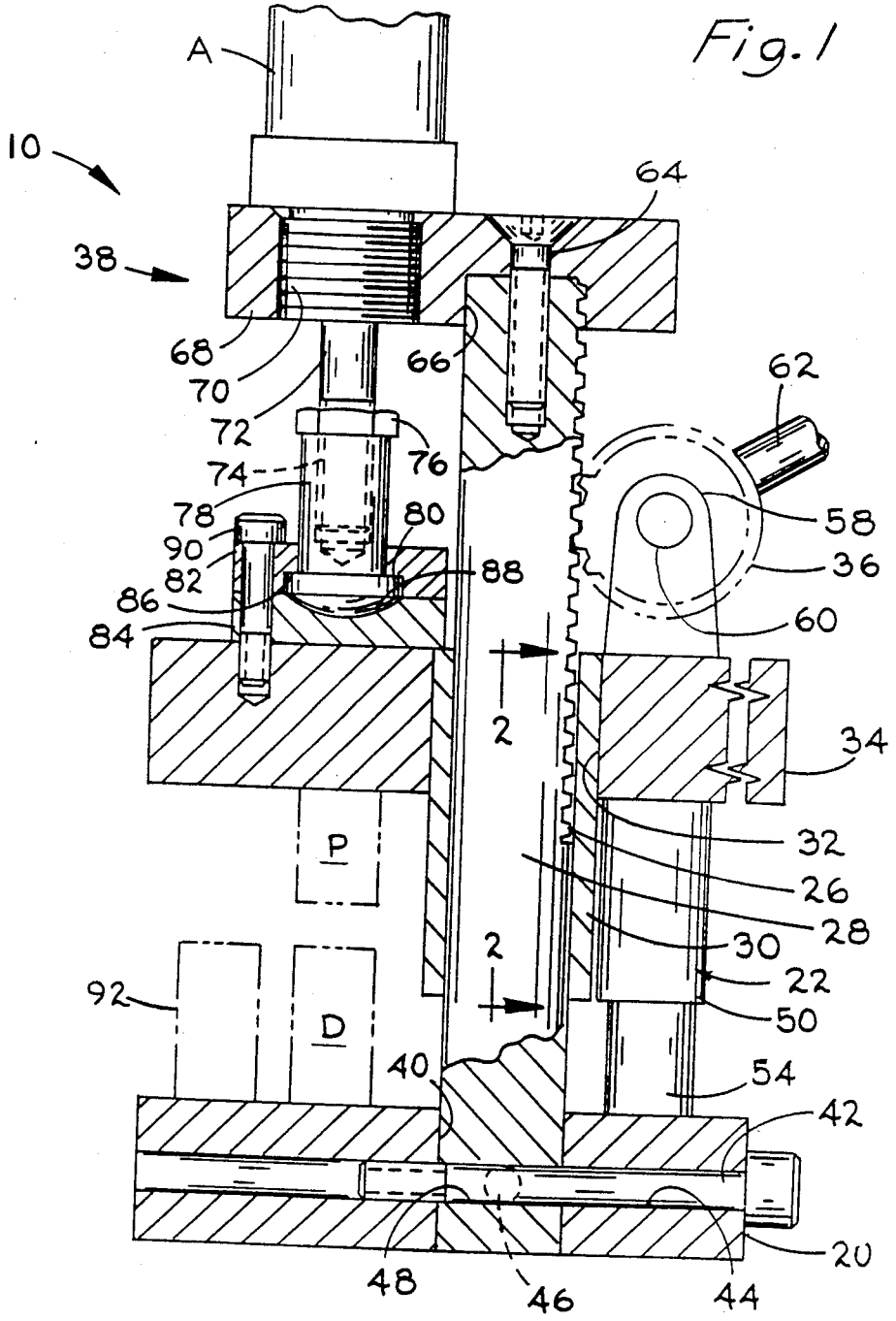
FIG. 1 is a side elevational partially sectional diagram showing general relation of the parts in an embodiment of the invention.

FIG. 1 shows the invention in embodiment 10 as including a base or lower plate 20, a pair of sliding guide assemblies 22 (24 shown in the next Figure) and a rack 26 and column or post 28 integral with it adjustably affixed in the lower plate and slidably engaging an upper plate sleeve 30 fixed in a hole 32 in the upper plate

34; a pinion 36 on the upper plate 34 engaging the rack 26 and a ram head 38 on the upper end of the post 28 for pressing together a die set, the upper portion of which may be a punch P and the lower a die D as diagrammed between the upper and lower plates.

Preferably the hole 32 for the rack 26 and post 28 is centrally located in at least the upper plate. The rack and post may advantageously be mounted to the lower plate in a hole 40 that passes centrally through the lower plate 20, at any of four selectable azimuthal angles or orientations, and is secured by a bolt 42 passing through the lower plate in a selective direction, through clearance holes 44, 46 and threaded in tapped hole 48 in the lower end of the post 28.

Reorientation of the rack and pinion with respect to the lower plate is easily and quickly done by this means.

The precision-fit bushing or sleeve 30 press-fitted into the upper plate 34, flush with the top of the upper plate, is two or more times as long as the upper plate thickness. One of similar bushings or sleeves 50 (52 shown in the next figure) is provided for each of the identical precision guide assemblies 22 (24 shown in the next figure). The guide pins 54 (56 shown in the next figure) of these assemblies are press-fitted into the lower plate 20 and the cylinders or sleeves are press-fitted into the upper plate, flush with the top of the upper plate.

The pinion 36 mounts by means of a bearing block 58 with an axle 60 through it and pinned to the pinion. The bearing block 58 is, as will be shown, screwed to the top of the upper plate.

A detachable handle, fragment shown at 62, may be used to rotate the pinion 36 and raise and lower the upper plate 34 with respect to the lower plate 20.

The ram head 38 on the upper end of the post 28 may be welded in place or may be detachably affixed by a screw 64 holding the upper end in a press-fit socket 66. The ram head 38 overhand 68 may have a screw-threaded hole 70 through it for attachment of the threaded end of an air cylinder A used as an alternative means of actuating the press by raising and lowering the upper plate 34. For this, the piston or ram 72 extends down and by means of a threaded end 74 and lock nut 76 adjustably holds a pressure thimble 78 with larger diameter hemispherical lower end 80.

A pair of clamp jaws 82, 84 have respectively a shaped hole 86 and a radiused recess 88 that fit and hold the pressure thimble for reciprocating operation, and one or more headed screws 90 threaded into the upper plate 34 and passing through coaxial holes in the clamp jaws 82, 84 fix the clamp jaws to the upper plate.

The rack and pinion can be used to crank to a desired height, when the air pressure drive is employed, for setting the stroke of the air cylinder by putting any selected height block 92 between the upper plate and the lower plate.

The block can be freely removable. It can have conventional provisions for height adjustment. Also 92 can be replaced with an adjustable stop between plates 34 and 20 by means of a nut and screw. By using a plate off column 28 an adjustable screw can be mounted at the top of the column 28 by discarding 38, using a plate with an adjustable screw and locknut and using screw 64 to attach it to column 28.

It will be noted that post or column 28 could be mounted off-center for convenience of the operator, if desired.

Figure 2:
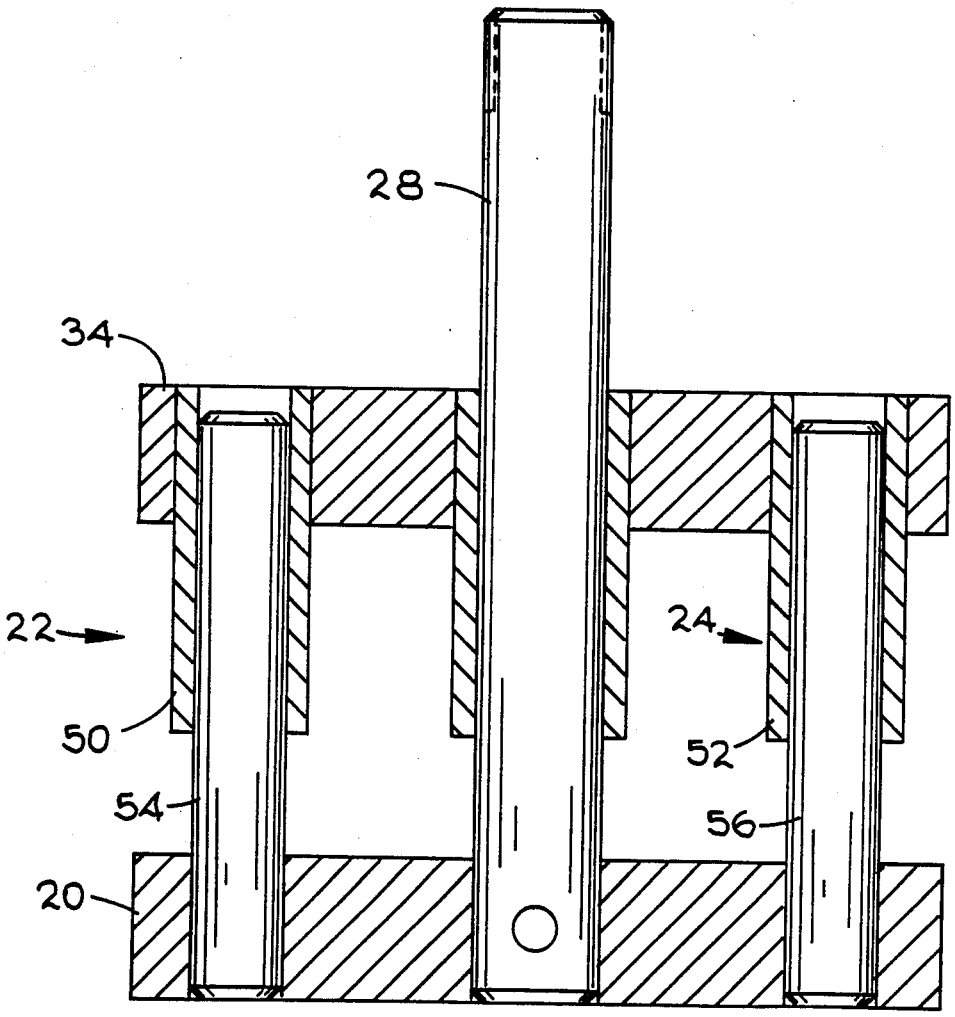
FIG. 2 is a partial-assembly view taken at 2—2, FIG. 1.

FIG. 2 shows in partial assembly view taken at 2—2, FIG. 1, the general relation of the upper and lower plates 34, 20 with the respective bushings or sleeves 50, 52 with which each pin 54, 56 of the assemblies 22, 24 makes a precision sliding fit.

Figure 3:
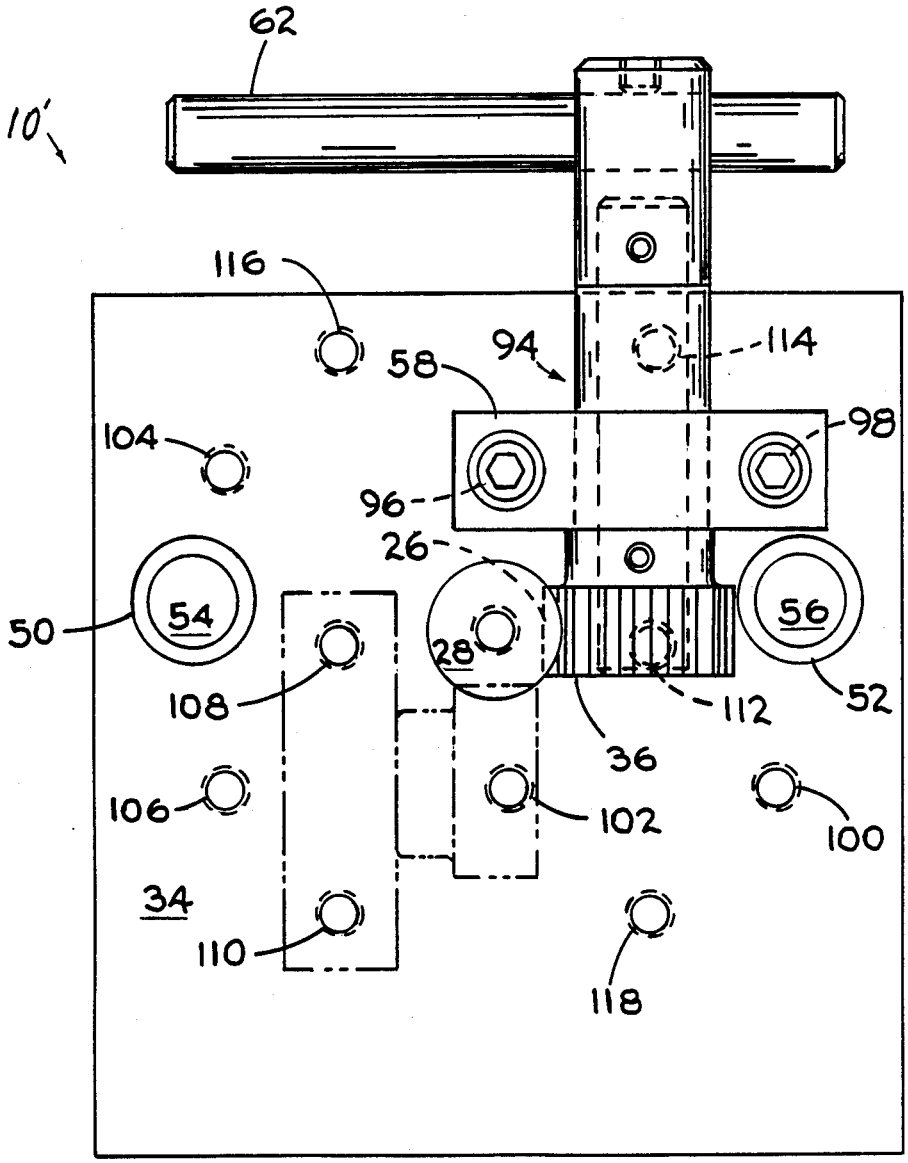
FIG. 3 is a top plan view of a further, preferred, embodiment with portions removed for exposition.

FIG. 3 shows a partial-assembly plan view to indicate the versatility of the invention. As noted, although the rack post 28 can be mounted in other positions, the rack post 28 may be advantageously located centrally in the upper plate 34 and in the lower plate. Central location in the upper plate makes possible other advantages of the invention in the embodiment 10'. Using a selected set of holes, the pinion 36 can be arranged so that it engages the rack 26 in any of four orientations of the rack 26 and in each of these orientations the handle can be disposed in a left-hand direction or in a right-hand direction, providing a total of eight variations:

(1) A first position of the pinion assembly 94 is shown at the top in solid lines. In this the rack 26 faces toward the right, "east" for exposition, and is engaged by the pinion 36, the bearing block 58 of which is mounted to the rear using tapped holes 96 and 98 in the upper plate 34.

(2) In a second position the rack still faces the same direction but the pinion assembly is reversed, or turned 180° and the pinion block is fastened at tapped holes 100, 102 in the uppper plate 34.

(3) In a third position the post 28 may be rotated 180° so that the rack 26 faces to the left, "west", and the pinion assembly is correspondingly secured, at holes 102 and 106 so that the pinion and rack engage.

(4) In a fourth position, the rack remains as in the third position but the pinion assembly is reversed, so that the pinion block is secured at holes 96 and 104.

(5) In a fifth position, shown in broken lines, the rack 26 faces "south" and the pinion assembly is secured at holes 108, 110.

(6) In a sixth position the rack faces in the same direction as in the fifth position, and the pinion assembly is reversed, being secured at holes 112 and 118.

(7) In a seventh position the rack 26 faces "north" and the pinion assembly is secured at holes 112 and 114.

(8) In an eight position the rack 26 remains as in the seventh position and the pinion assembly is recessed in holes 108 and 116.

It will be appreciated that only the twelve tapped holes provided are necessary if on the regular spacing intended, for positioning the two-hole block at eight places. This provides a saving of four holes or one-third, and a considerable saving in complexity of hole selection, because of the arrangement of four of the holes in the two centerlines passing through the centrally located post and rack 28, 26. It will be appreciated that any of the tapped holes mayb e used for holding the clamping plates previously referred to.

Sleeves or bushings 50, 52 and guide rods 54, 56 appear where indicated. The handle extensions, 62 shown, make it easy and convenient to crank the pinion from any one of the eight positions and in either direction, so that work can be advanced to the die set unimpeded by the handle.

It will be appreciated also that column or post 28 is similar to a round rod, guided by sleeve 30, but the post and rack could be of other sectional configuration.

Material for the assembly may be steel, with the plates and guides and post being proportional to use; at least one inch (2.5 cm) sections being preferred at a minimum. Also, aluminum construction could be used. The assembly bolts should be high-stress steel and as substantial as there is room for. The air cylinder and controls desired are also conventional.

The guides and sleeves are conventional commercially available units that may be brought from any tool supplier such as Superior Steel Corporation.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. A system of die set press having: a lower plate, and upper plate, means for moving the upper plate towards and away from the lower plate, including a plurality of guiding means connecting the lower plate with the upper plate, means for mounting respective portions of a die-set to the upper and lower plates characterized by: the means for moving including: a rack, means for connectng the rack with the lower plate and with the upper plate including means for affixing the rack at any of a plurality of orientations relative to the upper and lower plates, a hole in the upper plate with the rack slidably fitted therethrough and a pinion on the upper plate attached for moving up and down with the upper plate, and means for engaging the pinion with the rack at any of said plurality of orientations.

2. A system as recited in claim 1, the system further characterized by a ram, the rack having an upper end, means for fixing the ram to the upper end of the rack with a portion of the ram overhanging laterally from the rack, and a cylinder and piston assembly detachably affixed to said ram overhanging portion in position for pressing down on said upper plate and forcing together a said die-set.

3. A system as recited in claim 2, the means for engaging including a pinion support having structure defining at least a pair of fastening means with a spacing therebetween, and the upper plate having a plurality of pairs of said fastening means with each pair having said spacing therebetween arrayed in a rectangular pattern around said hole in the upper plate for providing a plurality of mounting positions for said pinion support fastening means.

4. A system as recited in claim 3, each of said pairs of fastening means having an equal spacing therebetween, and the rectangular pattern providing more mounting positions than there are fastening means on said upper plate.

5. A system as recited in claim 4, each of said fastening means comprising structure defining a hole.

6. A system as recited in claim 5, a handle extending from the pinion for rotation of the pinion, and said handle clearing the upper plate at any of said orientations when rotating.

7. A system as recited in claim 2, the means for connecting the rack with the lower plate comprising the lower plate having an aperture therein receiving a lower portion of the rack, a screw in the lower plate extending through a first hole in the rack, and a second hole at right angles to the first hole for extension of the screw therethrough at a said orientation of said plurality of orientations.

8. A system as recited in claim 7, and means for adjusting movement of the upper plate toward the lower plate by rotating the pinion, comprising a member of a selected height set on the lower plate.

9. A system as recited in claim 8, a holder for connecting the upper plate with said piston.

10. A system as recited in claim 2, means on the ram for adjusting said cylinder and piston assembly thereon.

* * * * *